United States Patent [19]

Kowbuz

[11] 4,363,652

[45] Dec. 14, 1982

[54] PROCESS FOR THE PRODUCTION OF HIGH PURITY IRON POWDER

[75] Inventor: Miro F. Kowbuz, Tucson, Ariz.

[73] Assignee: UOP Inc., Des Plaines, Ill.

[21] Appl. No.: 329,354

[22] Filed: Dec. 9, 1981

[51] Int. Cl.[3] ..... C22B 1/00; C22B 5/00

[52] U.S. Cl. ..... 75/0.5 AA; 75/0.5 BA; 75/1 R; 423/632

[58] Field of Search ..... 75/0.5 AA, 0.5 BA, 1 R; 423/332, 150, 632, 633

[56] References Cited

U.S. PATENT DOCUMENTS 4,136,158 1/1979 Okuda et al. ..... 423/632

4,154,608 5/1979 Carey et al. ..... 75/0.5 AA

*Primary Examiner*—Brian E. Hearn

*Assistant Examiner*—Robert L. Stoll

*Attorney, Agent, or Firm*—James R. Hoatson, Jr.; Raymond H. Nelson; William H. Page, II

[57] ABSTRACT

The removal of silica from an iron-bearing source which is treated to produce an iron powder which may be used in powder metallurgical applications may be facilitated by subjecting the reduced iron-bearing source such as magnetite to a sparge with an oxygen-containing gas such as oxygen or air prior to a caustic leach step. The sparge of the caustic-magnetite slurry is effected at ambient temperatures and pressures which may range from about 10 to about 1000 psi for a period of time ranging from about 0.1 to about 1 hour. By utilizing this sparge, the leaching capacity of the caustic leach solution appreciably increased.

10 Claims, No Drawings

PROCESS FOR THE PRODUCTION OF HIGH PURITY IRON POWDER

BACKGROUND OF THE INVENTION

Heretofore, various processes have been employed for obtaining metallic iron by the reduction of iron-bearing sources such as ore. For example, U.S. Pat. No. 3,585,023 discloses a process in which iron ore is mixed with a reducing agent such as a fossil fuel and forming the mixture into agglomerates. The thus formed agglomerates are then charged to an enclosed environment which utilizes hot solid inert particles as the heating medium, said enclosed environment being maintained in the absence of oxygen. Upon completion of the desired reduction, the particles and agglomerates are separated and the reduced agglomerates are allowed to partially cool before being exposed to the atmosphere. Following this, the reduced agglomerates are then recovered. Other methods utilize a heating and magnetic separation to effect a production of iron powder as well as effecting a physical separation by crushing, scalping, air cleaning, and screening, followed by subjecting the ore to a high intensity induced magnetic field. U.S. Pat. No. 2,728,655 discloses a method for producing iron powder with a low silica content in which an iron-containing material in finely divided form is admixed with a solid ash-containing carbonaceous reducing agent. The mixture is then heated to complete the reduction of the iron-containing material followed by cooling and recovery of the iron content.

As will hereinafter be shown in greater detail, it has now been discovered that by subjecting the iron-bearing source to a series of steps, it is possible to obtain an iron powder which will contain less than 0.1% silica, which is considerably less than the silica content of iron which remains after the normal treatment of iron-bearing sources.

SUMMARY OF THE INVENTION

This invention relates to an improvement in a process for the recovery of metallic iron from an iron-bearing source. More specifically, the invention is concerned with an improvement in a process for obtaining a high purity iron powder which, by utilizing the steps of the process hereinafter set forth in greater detail, will result in the obtention of an iron powder which is substantially freer of silica and other impurities, and which may then be utilized for a variety of powder metallurgy applications.

Heretofore, iron powder which is suitable for use in powder metallurgy applications was obtained from atomized iron powder which is relatively expensive to produce. Powdered iron which is substantially free of impurities such as silica (for example, iron which possesses a silica content less than about 0.1%) may be used for the production of certain types of steel in which the powder is directly rolled into sheet steel. In addition, another use of high purity iron powder is in molding in which the iron powder is directly pressed into different configurations for use as a particular part of various apparatus, rather than by casting which is the usual method for obtaining parts which possess a particular configuration.

It is therefore an object of this invention to provide a process for obtaining high purity metallic iron.

A further object of this invention is to provide a process for obtaining iron powder which possesses a silica content of less than about 0.1%.

In one aspect an embodiment of this invention resides in a process for the recovery of metallic iron from an iron-bearing source which comprises the steps of: (a) grinding said iron-bearing source; (b) leaching the ground iron-bearing source in a caustic leach solution at an elevated temperature and pressure; (c) separating the impurities from the caustic leach residue; (d) reducing the iron in said caustic residue by treatment with hydrogen at an elevated temperature and pressure; (e) recovering the resultant metallic iron, the improvement which comprises subjecting said ground iron-bearing source in the caustic leach solution to a sparge with an oxygen-containing gas at sparging conditions prior to said caustic leach of said ground iron-bearing source.

A specific embodiment of this invention is found in a process for the recovery of metallic iron from an iron-bearing source which comprises the steps of reducing an iron concentrate by treatment with hydrogen at a temperature in the range of from about 700° to about 1300° F. and a pressure in the range of from about atmospheric to about 500 pounds per square inch, thereafter subjecting the reduced source to at least one magnetic separation step to separate impurities therefrom, grinding the iron-bearing source to a desired particle size, sparging said ground iron-bearing source with an oxygen-containing gas at ambient temperature and a pressure in the range of from about 10 to about 1000 pounds per square inch for a period of time in the range of from about 0.1 to about 1 hour, subjecting the ground iron-bearing source to a caustic leach by treatment with sodium hydroxide at a temperature in the range of from about 200 to about 700 psi to solubilize impurities such as silica, aluminum, calcium and magnesium, filtering the leach mixture, washing the residue with a water solution containing hydrochloric acid, filtering the solution, thereafter subjecting the residue to a second reduction step by treatment with hydrogen at a temperature in the range of from about 700° to about 1900° F., grinding the reduced iron to a particle size in the range of from about −40 mesh to about +270 mesh, thereafter subjecting the ground iron to at least one magnetic separation step to further separate any impurities which may still be present, and recovering the purified iron powder.

Other objects and embodiments will be found in the following detailed description of the present invention.

DETAILED DESCRIPTION OF THE INVENTION

As hereinbefore set forth, the present invention is concerned with an improvement in a process for obtaining high purity powder from an iron-bearing source. By effecting the process utilizing a sparging step as one particular sector of the process, it has been found possible to considerably reduce the silica content of the iron powder, thus enabling the powder to be used for a variety of powder metallurgic purposes. Several advantages in the treatment of the iron-bearing source when utilizing the various steps of the process of the present invention will become apparent when discussing the process. The iron-bearing source which may be utilized as the feedstock for the present invention will comprise hematite ($Fe_2O_3$) and magnetite ($Fe_3O_4$) concentrates which are widely available from many sources, the most common source which is presently available being hematitic in nature. However, the concentrates usually contain a relatively large amount of silica ($SiO_2$) as the major gangue mineral in amounts ranging from about 1 to about 7%. In addition, other impurities are also present such as minor amounts of aluminum, calcium, magnesium, etc. In order to be able to use iron powder for various metallurgical purposes, it is necessary to remove the impurities, especially silica, and reduce the concentration of the silica to less than about 0.1%. To effectively attain the desired result, the iron-bearing source such as hematite must be processed through a series of steps in order to reduce the iron oxide concentrate to pure iron.

The process for obtaining the desired metallic iron is effected by subjecting an iron-bearing source such as hematite or magnetite to a grinding process whereby the iron ore is reduced to a desired particle size. The particle size will be such that a major portion of the silica is liberated from the iron and therefore the desired particle size should be about −200 mesh, this size being sufficient to effectively separate the silica particles from the ore.

Following the grinding of the iron-bearing source to the desired particle size, the particles may then be placed in a caustic leach vessel. The leach solution which is utilized will comprise an aqueous sodium hydroxide solution which contains from about 100 to about 200 grams per liter of sodium hydroxide, although a lesser amount or greater amount of sodium hydroxide may be employed if so desired. In one embodiment of the invention, the caustic leach solution which contains the particles is subjected to a sparge by charging an oxygen-containing gas such as air or oxygen to a pressure-resistant vessel in which the caustic leach solution containing the iron-bearing particles is placed. The sparging of the solution with the oxygen-containing gas is effected at sparging conditions which will include ambient temperatures and superatmospheric pressures which may range from about 10 to about 1000 pounds per square inch (psi). The sparging of the solution which will permit the leaching operation to more effectively extract silica will take place during a period of time which may range from about 0.1 to about 1 hour or more in duration. As an alternative, it is also contemplated within the scope of this invention that the aforementioned sparging of the leaching solution containing the iron-bearing particles may also be effected simultaneously with the leaching step of the process. As will hereinafter be shown in greater detail, by sparging the solution, it is possible to obtain an almost complete extract of silica from the iron-bearing source, which may result in an economical advantage for the process.

In the event that the sparging of the leach solution containing the iron-bearing particles is effected prior to the leach step of the process, the solution is then subjected to the caustic leach. The leach is effected at temperatures which may range from about 300° to 500° F. at an implied pressure in the range of from about 200 to about 700 psi. After treating the ore with the caustic solution for a period of time which may range from about 0.5 up to about 4 hours or more in duration, the silica particles in the leach head material will form sodium silicate of varying composition and which will be soluble in nature. The caustic treatment of the ore will result in the reduction of the silica content present in the original ore down to less than 1%. Following the treatment of the ore within the reaction parameters set forth above, the solid ore which may also contain insoluble silicates of aluminum, calcium and magnesium, will be separated from the leach liquor by conventional means such as filtration, centrifugation, decantation, etc. The residue may then be subjected to a reducing process in which the iron is treated with hydrogen at an elevated temperature and pressure for a predetermined period of time in either a one or two-step reduction process. In one embodiment, the iron ore is reduced by treatment with hydrogen at a pressure in the range of atmospheric to about 500 psi in a two-step process, the first step being effected at a temperature in the range of from about 700° to about 1300° F. The oxygen level in the iron will be reduced to less than 5%; however, the iron oxide particles at this point in the process are highly pyrophoric and therefore must be protected by an inert atmosphere which is provided for by the presence of nitrogen before being subjected to the second stage of the reduction step. The second stage reduction is effected at temperatures ranging from about 1600° to about 1900° F. and serves to completely reduce the iron oxide to iron powder. In addition to reducing the iron oxide to metallic iron, the second stage of the reduction process also serves to sinter the surface of the iron particles in such a manner so that the pyrophoricity of the particles is eliminated and therefore the iron particles may be exposed to the atmosphere with the concurrent elimination of the necessity of an inert gas such as nitrogen being present.

It is also contemplated within the scope of this invention that various other steps in the process may be employed in addition to those hereinbefore enumerated in order to insure the fact that the final amount of silica which is present in the metallic iron will be less than 0.1%. For example, the iron concentrate which may contain up to about 7% silica may be subjected to a reduction step which is effected by treating the iron concentrate with hydrogen at a temperature in the range of from about 700° to about 1300° F. and at pressures ranging from atmospheric to about 500 psi. When utilizing this step, the hematite will be reduced to magnetite. In addition to using pure hydrogen, it is also contemplated that other reducing agents such as a mixture of hydrogen and carbon monoxide may also be employed. Following the reduction of the hematite to magnetite, the iron which is present in the ore is highly magnetic and therefore the bulk of the silica contaminant is susceptible to being removed prior to subjecting the iron-bearing ore to a sparging operation which, in turn, will be effected prior to the caustic leach of the particles. By utilizing the first reduction step, it is possible to reduce the consumption of the caustic during the leaching operation, thus effecting a savings in the operating expenses of the process. The removal of the silica gangue material from the magnetite may be accomplished by passing the ore through a permanent magnet separator. If so desired, the ore may be passed through this separator more than once; for example, the ore may be passed through the separator and recycled up to about three or four times, thus insuring a more complete separation of the magnetic iron product from the silica. The silica particles which are separated from the magnetite will tend to be the largest particles present and thus the silica which remains in the magnetite will be in the shape of rather fine particles, said fine particles being more susceptible to the caustic leach of the ore.

Following the magnetic separation of the large silica particles from the magnetite, the latter may then be ground in a ball mill to a desired particle size which is suitable for the caustic leaching stage of the process. For example, the product may be ground so that the particles are present in a range of from about −100 to about +270 mesh. After grinding the ore to the desired particle size, it is then placed in the leach solution similar to that hereinbefore set forth, and sparged by treatment with an oxygen-containing gas under similar conditions to those previously mentioned. Following the sparging of the ore particles, it is then subjected to a caustic leach in a manner similar to that hereinbefore set forth whereby the soluble sodium silicates are separated from the insoluble magnetite. The separation of the iron from the soluble sodium silicates is facilitated inasmuch as magnetite leach residue filters at a rate which is more rapid than the hematite leach residue, thus permitting the separation step to be effected in a more advantageous manner. Following the separation of the solid magnetite, it is then washed with hot water at a temperature of from about 150° to about 200° F. to completely remove any traces of caustic leach liquor which may still be present on the ore.

Another step which may be employed to permit the recovery of a pure iron product is subjecting the magnetite solids from the filtration step, which may still contain some metal silicates such as aluminum silicate, calcium silicate, magnesium silicate, etc., as well as any sodium silicate which may have reprecipitated during the separation step, to the action of a weak acid solution. The acid wash is preferably effected at a temperature ranging from about ambient (68°–77° F.) to about 86° F. and atmospheric pressure for a period of time which may range from about 0.5 up to about 5 hours or more, the duration of the wash being that which is sufficient to dissolve any silica compounds which may be present. In the preferred embodiment of the invention, the acid wash comprises an aqueous hydrochloric acid solution which may contain from about 2 to about 10% hydrochloric acid, although it is also contemplated within the scope of this invention that other acids such as sulfuric acid, nitric acid, etc., may also be employed, but not necessarily with equivalent results. Upon completion of the residence time in the acid bath, the repulped solids are then filtered utilizing any conventional filtration equipment or, if so desired, the separation of the acid bath from the solids may be accomplished by other means such as decantation, etc. As in the previous step, the residue is again washed with hot water, dried and thereafter the residue is subjected to a second reduction step.

As was also previously described, the reduction of the residue may be accomplished in one or more stages. The first stage is effected by treating the magnetite with pure hydrogen at a temperature in the range of from about 700° to about 1300° F. while the second stage is effected in the presence of hydrogen at higher temperatures ranging from about 1600° to about 1900° F. The result of this two-stage reduction will be to lower the oxygen content of the iron powder to approximately 0.2%. Upon cooling the residue after reduction thereof, the residue will be in an agglomerated form and therefore must be subjected to a grinding step whereby the power is reduced to a suitable particle size. The grinding of the iron to the desired particle size may be accomplished using any conventional grinding equipment such as a ball mill which will enable the operator to adjust the particle size to any mesh, said size being dependent upon the end use of the material.

Following the grinding of the iron to form the desired particle size, the powder may then be subjected to a second series of magnetic separations which will serve as a clean-up stage for any foreign particles which may still be present in the iron powder. After passage through the magnetic separator for at least one pass and preferably up to about three passes, the iron powder which is recovered will contain less than 0.1% silica. The silica compounds which remain in the iron powder in the amount hereinbefore set forth will not be discrete in form, but will be of submicron particle size and will be very finely dispersed throughout the powder. By virtue of being in submicron particle size, the finely dispersed silicon compound will not be detrimental for the use of iron powder in metallurgical applications.

By utilizing the steps hereinbefore set forth which includes the sparging operation prior to or concurrent with the caustic leaching operation, it is possible to extract at least 99.5% and in many instances at least 99.9% of the silica with a minimal loss of iron during the process. In addition to the recovery of substantially all of the silica, the oxygen content of the powder will also be minimal in nature and will not interfere with the desired uses of the iron powder.

The following examples are given for purposes of illustrating the process of the present invention, however, it is to be understood that these examples are merely for purposes of illustration and that the present process is not necessarily limited thereto.

EXAMPLE I

An iron ore concentrate which contains 5% silica was reduced by treatment with hydrogen at a temperature of about 950° F. and atmospheric pressure until the hematite was reduced to magnetite. The magnetite product was separated from the silica gangue material by passage through a permanent magnetic separator, the original silica in the starting material being reduced by means of the magnetic separator to about 0.35% (15.89 grams in 4540 grams of ore) silica.

The magnetite product which was recovered from a magnetic separator was ground in a ball mill to a particle size which ranged from −100 mesh to +325 mesh. Following this, the ground magnetite was leached in a pressure autoclave with a caustic solution which contained 250 grams of sodium hydroxide per liter, said leach operation being effected at a temperature of 500° F. for a period of two hours and at a pressure of 700 psi. The caustic leach slurry was filtered using a pressure filter heated to 175° F. and the filtration residue was washed with hot water which had a temperature of about 150° F. to remove any traces of caustic leach liquor which may still have been present on the solids. Analysis of the magnetite determined that 70.1% (11.1 grams) of the silica had been removed by the leach, the silica remaining in the tails comprising 0.105%. The solids from the caustic leach were then treated with a weak hydrochloric acid solution containing about 5% by weight of hydrochloric acid, said washing being effected at room temperature for a period of about 30 minutes. At the end of the 30 minute period, the hydrochloric acid leach slurry was filtered and the residue again washed with hot water to remove any residual hydrochloric acid.

The washed magnetite was then dried with pure hydrogen at a temperature in the range of 700° to about 1300° F. to lower the oxygen level in the ore to less than 5%. Upon completion of the reduction, the temperature was increased to a range of from about 1600° to about 1900° F. whereby the iron oxide was completely reduced to an iron powder.

EXAMPLE II

To illustrate the process of the present invention which includes a sparging step of the magnetite prior to the caustic leach of the ore, the iron ore concentrate similar in nature to that set forth in Example I above was treated with hydrogen at a temperature of 950° F. to reduce the hematite to magnetite. The magnetite product was separated from silica gangue material by passing through a permanent magnetic separator to reduce the silica content to about 0.35% (15.89 grams in 4540 grams of the ore). Following this, the 4540 grams of magnetite were placed in 6 liters of a caustic leach containing 250 grams of sodium hydroxide per liter of water. The leach solution was placed in an autoclave and sparged by treatment with oxygen for a period of 0.5 hours at ambient temperature and a pressure ranging from 10 to 1000 psi. At the end of the 0.5 hour sparging period, the magnetite was leached at a temperature of 500° F. for a period of 2 hours under a pressure of 700 psi. Upon completion of the caustic leach, the slurry was filtered and the residue was recovered, washed with a hot water and analyzed. Analysis of this residue determined that approximately 90% (14.3 grams) of the silica had been leached from the magnetite, only 0.035% silica remaining in the ore. It is therefore readily apparent from a comparison of the silica content of the iron powder produced in Example I, that is, 0.105% to that of the silica content of the iron powder produced according to the process of the present invention as set forth in this Example, that is, 0.035%, that the silica content of the powder is reduced by about 66%.

Further treatment of the ore in a manner sililar to that set forth in the above example resulted in the obtention of an iron powder which was suitable for use in powder metallurgical applications.

I claim as my invention:

1. In a process for the recovery of metallic iron from an iron-bearing source which comprises the steps of:

(a) grinding said iron-bearing source;

(b) leaching the ground iron-bearing source in a caustic leach solution at an elevated temperature and pressure;

(c) separating the impurities from the caustic leach residue;

(d) reducing the iron in said caustic residue by treatment with hydrogen at an elevated temperature and pressure;

(e) recovering the resultant metallic iron, the improvement which comprises subjecting said ground iron-bearing source in the caustic leach solution to a sparge with an oxygen-containing gas at sparging conditions prior to said caustic leach of said ground iron-bearing source.

2. The process as set forth in claim 1 in which said sparging conditions include ambient temperatures and a pressure in the range of from about 10 to about 1000 pounds per square inch.

3. The process as set forth in claim 1 in which said oxygen-containing gas is air.

4. The process as set forth in claim 1 in which said oxygen-containing gas is oxygen.

5. The process as set forth in claim 1 in which said sparge is effected for a period of time in the range of from about 0.1 to about 1 hour.

6. The process as set forth in claim 1 in which said caustic leach is effected at a temperature in the range of from about 300° to about 500° F. and a pressure in the range of from about 200 to about 700 pounds per square inch.

7. The process as set forth in claim 1 in which said residue from said caustic leach is treated with an acid to remove impurities therefrom.

8. The process as set forth in claim 7 in which said acid is hydrochloric acid.

9. The process as set forth in claim 7 in which said residue from said acid treatment is reduced by treatment with hydrogen at a temperature in the range of from about 700° to about 1900° F.

10. The process as set forth in claim 9 in which said reduced iron is ground and subjected to at least one magnetic separation step to remove impurities therefrom.

* * * * *